US007645157B2

(12) United States Patent
Mizutani et al.

(10) Patent No.: US 7,645,157 B2
(45) Date of Patent: Jan. 12, 2010

(54) CONNECTOR

(75) Inventors: Tatsuhiko Mizutani, Toyota (JP); Akira Otagaki, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 219 days.

(21) Appl. No.: 11/884,793

(22) PCT Filed: Feb. 10, 2006

(86) PCT No.: PCT/JP2006/302792

§ 371 (c)(1),
(2), (4) Date: Aug. 21, 2007

(87) PCT Pub. No.: WO2006/098113

PCT Pub. Date: Sep. 21, 2006

(65) Prior Publication Data

US 2008/0261414 A1 Oct. 23, 2008

(30) Foreign Application Priority Data

Mar. 15, 2005 (JP) ..... 2005-073511

(51) Int. Cl.
*H01R 4/38* (2006.01)

(52) U.S. Cl. ..... 439/382; 439/2

(58) Field of Classification Search ..... 439/2, 439/382–385

See application file for complete search history.

(56) References Cited

U.S. PATENT DOCUMENTS 4,324,449 A * 4/1982 Watanabe et al. ..... 439/353
5,190,482 A * 3/1993 VanDerStuyf et al. ..... 439/686
5,334,806 A * 8/1994 Avery ..... 181/286
5,682,289 A * 10/1997 Schwegler et al. ..... 361/679.33
5,876,235 A * 3/1999 Yoshigi ..... 439/384
6,007,307 A * 12/1999 Sonoda ..... 417/312
6,019,621 A * 2/2000 Sugata et al. ..... 439/164
6,460,642 B1 10/2002 Hirano
6,527,579 B2 * 3/2003 Sato et al. ..... 439/382
7,150,631 B2 * 12/2006 Reed et al. ..... 439/34
7,264,506 B2 * 9/2007 Mori et al. ..... 439/606
7,497,691 B2 * 3/2009 Urano ..... 439/34
2008/0261414 A1 * 10/2008 Mizutani et al. ..... 439/34

FOREIGN PATENT DOCUMENTS

EP 0 848 460 A1 6/1998
EP 1 126 559 A1 8/2001
JP 07-42070 7/1995
JP 08-017536 1/1996
JP 2001-176602 6/2001
JP 2003-068417 3/2003

* cited by examiner

*Primary Examiner*—James Harvey
(74) *Attorney, Agent, or Firm*—Kenyon & Kenyon LLP

(57) ABSTRACT

A connector includes a main body supporting a power cable, and a sound-proof member attached by a bolt to the top surface of the main body identified as the sound emitting surface to absorb sound emitted from the main body due to vibration. The main body includes a base provided with bulges in which three power cables are accommodated, respectively, and a lid over the base with power cables accommodated. The sound-proof member is effective as long as it is attached to the side face of the lid where it is expected to readily emit noise, i.e., on one side. The sound proof member can be also attached to the side face of the base. A connector having sound generated from the connector caused by vibration reduced is provided.

14 Claims, 4 Drawing Sheets

CONNECTOR

This is a 371 national phase application of PCT/JP2006/302792 filed 10 Feb. 2006, which claims priority of Japanese Patent Application No. 2005-073511 filed 15 Mar. 2005, the contents of which are incorporated herein by reference.

TECHNICAL FIELD

The present invention relates to connectors, particularly a connector employed in a connecting portion to which vibration is applied.

BACKGROUND ART

A connector is a component employed for connecting electric wiring. Particularly in the case where the connector is employed for a wiring harness to which vibration of the vehicle is applied, there is a possibility of the connector, if of a general type, being detached by vibration.

Japanese Patent Laying-Open No. 2001-176602 discloses the technology of improving adhesion between a connector and a vibration isolation cover to ensure the vibration isolation capability by incorporating a rubber member between the connector employed in a vehicle and the vibration isolation cover.

In recent years, attention has been directed to electric cars, fuel cell electric vehicles and hybrid vehicles in consideration of the high fuel cost and environmental grounds. Such vehicles are mounted with motors for driving wheels, high voltage batteries, and the like. A power cable that can conduct high tension current to transmit power thereto is employed.

The power cable is connected to the motor by a connector due to the ease in assembly and maintenance. Such a connector is large in size, as compared to a conventional connector employed for an on-vehicle wiring harness.

Vibration of a large connector in response to vibration of the motor can cause generation of noise.

Although the vibration-proof connector disclosed in the aforementioned Japanese Patent Laying-Open No. 2001-176602 takes into account the issue of preventing connector detachment by suppressing vibration thereof, the publication is silent about suppressing the spread of noise generated from the connector (the drumming noise caused by a portion or the entirety of the surface of the connector vibrating likewise the surface of a drum) when an object of vibration and the connector are fastened together.

DISCLOSURE OF THE INVENTION

An object of the present invention is to provide a connector having sound generated from the connector caused by vibration reduced.

According to the present invention, a connector includes a main body supporting a wiring, and a sound-proof member attached to at least a first face of the main body to absorb sound generated from the main body caused by vibration.

Preferably, the sound-proof member includes a cover facing the first face, and a sound absorbing material located between the cover and the first face.

More preferably, the sound-proof member further includes a sound insulation material provided at the cover so as to wrap around the sound absorbing material.

Further preferably, the connector further includes a fastening member fastening the cover to the main body.

More preferably, the main body is made of metal, and the cover is made of resin.

Preferably, the main body has a portion inserted in a housing that vibrates during operation. The sound-proof member is attached to a portion of the main body protruding from the housing in a state where the main body has a portion inserted in the housing.

Further preferably, the main body has a shape in which the width of the cross section is greater than the height. The first face corresponds to the surface along the width direction of the cross section.

Preferably, the main body includes a first member formed with a recess in which the wiring is to be accommodated, and a second member forming a lid over the first member with the wiring accommodated. The first face corresponds to a portion of the second member.

Preferably, the main body is attached to a housing of an on-vehicle rotating electric machine. The wiring is a power wiring to supply power to the on-vehicle rotating electric machine.

Preferably, the power wiring includes a plurality of power cables. The plurality of power cables are accommodated in the main body in a juxtaposing manner. The first face corresponds to the surface along the direction in which the plurality of power cables are juxtaposed.

In accordance with the present invention, the spread of noise generated from the surface of the connector fastened to a vibrating object towards the surrounding can be prevented.

The foregoing and other objects, features, aspects and advantages of the present invention will become more apparent from the following detailed description of the present invention when taken in conjunction with the accompanying drawings.

BEST MODE FOR CARRYING OUT THE INVENTION

Figure 1:
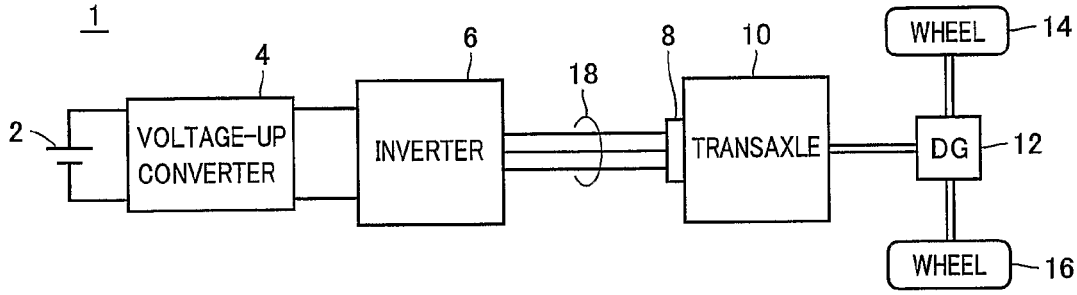
FIG. 1 is a block diagram of a structure of a vehicle in which a connector according to an embodiment of the present invention is applied.

An embodiment of the present invention will be described in detail with reference to the drawings. In the drawings, the same or corresponding components have the same reference characters allotted, and description thereof will not be repeated.

The vehicle shown in FIG. 1 in which the connector of the present invention is applied may be, for example, an electric car, a hybrid vehicle, a fuel cell electric vehicle, and the like.

Referring to FIG. 1, the vehicle includes a direct current power supply 2, a voltage-up-converter 4 boosting the voltage output from direct current power supply 2, an inverter 6 converting the direct current voltage boosted by voltage-up-converter 4 into a 3-phase alternating current, a transaxle 10 incorporating a motor driven by inverter 6, a differential gear 12 connected to the output shaft of transaxle 10, and wheels 14 and 16 driven by differential gear 12.

Connection is established between inverter 6 and transaxle 10 by a 3-phase power cable 18. A connector 8 is employed at the connection between power cable 18 and transaxle 10.

Figure 2:
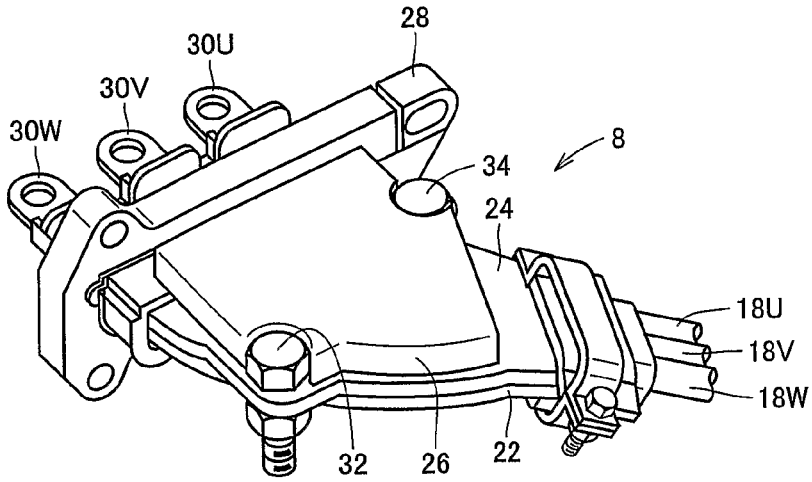
FIG. 2 is a perspective view of a connector 8.
Figure 3:
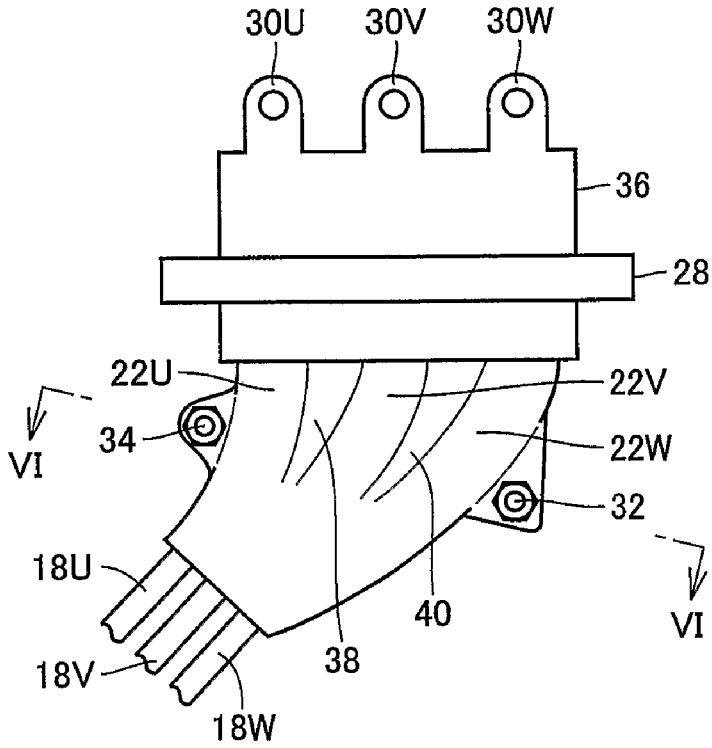
FIG. 3 is a back side view of connector 8.

Referring to FIGS. 2 and 3, connector 8 includes a main body supporting power cable 18, and a sound-proof member 26 attached by bolts 32 and 34 to the top surface of the main body that is the main surface from which sound is generated. Sound-proof member 26 absorbs sound generated from the main body caused by vibration.

The main body is attached to the housing of transaxle 10 of FIG. 1 including an on-vehicle rotating electric machine. The power cable is a power wiring supplying power to the on-vehicle rotating electric machine.

Connector 8 further includes terminals 30U, 30V, and 30W electrically connected to power cables 18U, 18V and 18W, respectively, a connector insertion unit 36 supporting terminals 30U, 30V and 30W, and a stopper 28 provided at an insertion limit such that connector insertion unit 36 is inserted up to a predetermined length.

The main body of connector 8 includes a base 22 formed with bulges 22U, 22V and 22W to store the three power cables 18U, 18V and 18W, respectively, and a lid 24 over base 22 with power cables 18U, 18V and 18W accommodated therein.

The main body of connector 8 has a cross sectional configuration in which the width is larger than the height since the main body supports the three power cables in a juxtaposed manner. Therefore, the main body has a broad and flat shape such that sound is readily generated by vibration from lid 24. The sound emitting surface where sound-proof member 26 is attached corresponds to the face in the direction of width of the cross section.

The main body of connector 8 has its portion up to stopper 28 inserted into the housing of transaxle 10 of the vehicle that vibrates during motion. Sound absorbing member 26 is attached to a portion of the main body protruding from the housing with a portion of the main body inserted in the housing.

Base 22 includes valleys 38 and 40 between bulges 22U, 22V and 22W, when viewed from the back side. Base 22 therefore has a structure with higher rigidity than lid 24 even though the thickness is the same. It is therefore considered that lid 24 vibrates and emits sound more readily than base 22.

In the example shown in FIG. 2, sound-proof member 26 is attached to the face of the side of lid 24 where it is expected that sound is readily generated. The attachment of sound-proof member 26, though only at one side, is advantageous in sound isolation. The sound-proof member may also be attached at the side face corresponding to base 22.

Figure 4:
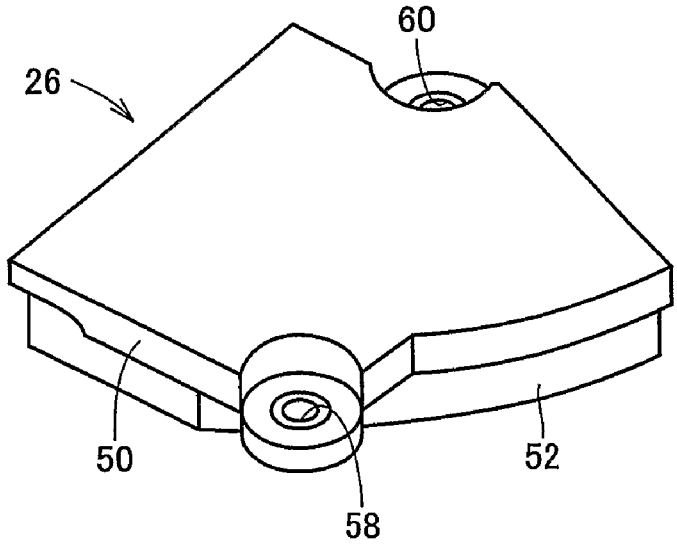
FIG. 4 is a perspective view from the top side of a sound-proof member 26.
Figure 5:
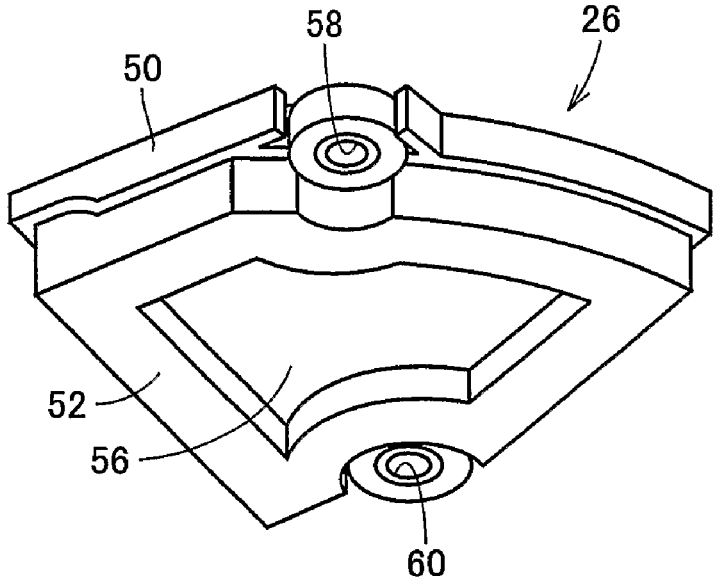
FIG. 5 is a perspective view from the back side of sound-proof member 26.

Referring to FIGS. 4 and 5, sound-proof member 26 includes a cover 50 facing the sound emitting surface of connector 8, and a sound absorbing material 56 located between cover 50 and the sound emitting surface.

Sound-proof member 26 further includes a sound insulation material 52 provided so as to surround sound absorbing material 56 such that sound absorbing material 56 absorbs sound without any leakage.

Sound-proof material 56 may be a layer of polyester non-woven fabric, glass wool, urethane, and the like. Sound insulation material 52 may be an open-cell foam type soft sponge-like foam obtained by foaming a mixture of a fire retardant mixed into synthesized rubber. Such sound absorbing material and sound insulation material may be the general type commonly employed for interior components of a vehicle.

Cover 50 is provided with bolts holes 58 and 60 to be fastened to base 22 together with lid 24 of the main body of connector 8. Bolts 32 and 34 of FIG. 2 are fitted in bolt holes 58 and 60, respectively, and fastened with nuts.

Figure 6:
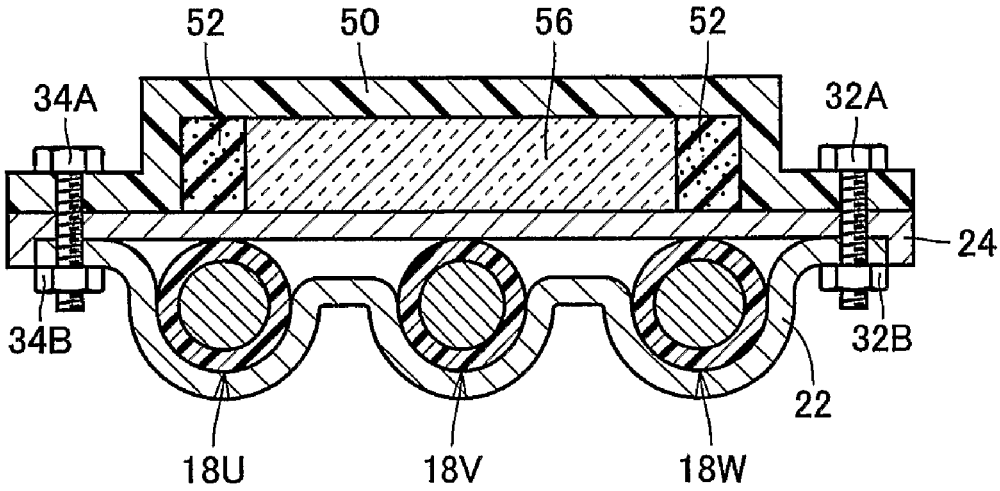
FIG. 6 is a sectional view taken along line VI-VI of FIG. 3.

Referring to FIG. 6, base 22 and lid 24 of the main body is formed of metal such as aluminum, for example, and cover 50 is formed of resin.

Base 22 is identified as the first member of the connector main body provided with a recess in which the wiring is accommodated. Lid 24 is identified as the second member forming a lid on base 22 that is the first member, with the wiring accommodated. Cover 50 serving as a sound proof member is attached to the top surface of lid 24 by bolts 32A and 34A and nuts 32B and 34B.

By virtue of attachment by means of bolts 32A and 34A and nuts 32B and 34B, sound insulation material 52 is pressed appropriately to be flush with cover 50, whereby sound leakage is suppressed. In this state, sound absorbing material 56 is brought into contact with or is suitably adjacent to lid 24.

The power is transmitted to the vehicle motor by a plurality of power cables 18U, 18V and 18W. Each of power cables 18U, 18V and 18W includes a conductive metal core and an insulative cover thereon. Power cables 18U, 18V and 18W are accommodated in base 22 of the main body of connector 8 in a juxtaposed manner, as shown in FIG. 6. The face where cover 50 identified as a sound proof member is attached corresponds to the face along which the power cables are juxtaposed, and corresponds to the top surface of lid 24.

Figure 7:
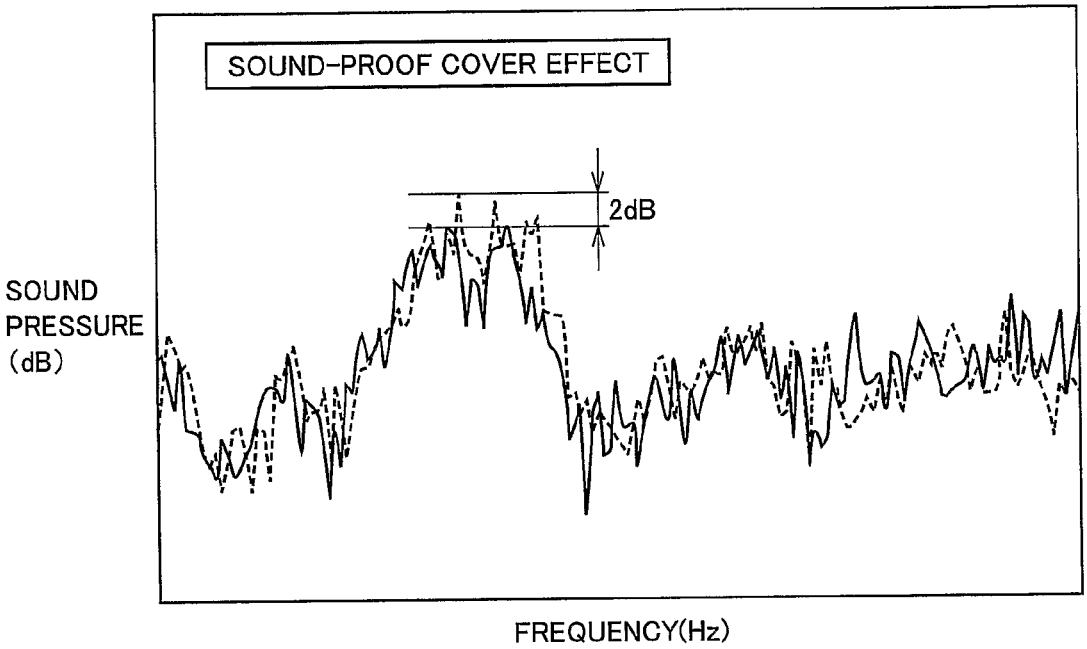
FIG. 7 represents data obtained by observing sound generated from the connector when sound-proof member 26 is attached to and not attached to the connector of the present embodiment.

FIG. 7 represents data based on observation of noise from the connector when sound-proof member 26 is attached and not attached to the connector of the present embodiment.

In FIG. 7, the solid line corresponds to the case where sound-proof member 26 is attached to the connector main body, and the broken line corresponds to the case where sound-proof member 26 is not attached. It is appreciated from FIG. 7 that the sound-proof member is effective corresponding to the region where the peak value of the sound pressure is reduced by 2 db in the vicinity of approximately 3,000 Hz in frequency.

In accordance with the present embodiment, the spread of sound generated from the connector can be prevented. This contributes to realization of a quiet vehicle particularly for the on-vehicle type. The connector of the present embodiment is particularly advantageous in the case where quietness is required in the passenger compartment in vehicles having low running noise such as a hybrid vehicle and fuel cell vehicle.

Although the present invention has been described and illustrated in detail, it is clearly understood that the same is by way of illustration and example only and is not to be taken by way of limitation, the spirit and scope of the present invention being limited only by the terms of the appended claims.

The invention claimed is:

1. A connector comprising:

a main body supporting a wiring, and a sound-proof member attached to at least a first face of said main body to absorb sound emitted from said main body by vibration, wherein said sound-proof member is attached to a portion of said main body protruding from a housing that vibrates during operation and another portion of said main body is inserted into said housing.

2. The connector according to claim 1, wherein said sound-proof member comprises a cover facing said first face, and a sound absorbing material located between said cover and said first face.

3. The connector according to claim 2, wherein said sound-proof member further comprises a sound insulation material provided at said cover to wrap around said sound absorbing material.

4. The connector according to claim 2, further comprising a fastening member fastening said cover to said main body.

5. The connector according to claim 2, wherein said main body is formed of metal, and said cover is formed of resin.

6. The connector according to claim 1, wherein said main body is attached to a housing of an on-vehicle rotating electric machine, and has a shape in which a width is larger than a height of a cross section, said wiring includes three-phase power cables supplying power to said on-vehicle rotating electric machine, and said three-phase power cables are accommodated in said main body in a juxtaposed manner along a direction of said width of said main body.

7. The connector according to claim 1, wherein said main body has a shape in which a width is larger than a height of a cross section, and said first face corresponds to a face along a direction of width at said cross section.

8. The connector according to claim 1, wherein said main body comprises a first member formed with a recess in which said wiring is to be accommodated, and a second member forming a lid over said first member with said wiring accommodated, said first face corresponding to a portion of said second member.

9. The connector according to claim 1, wherein said main body is attached to a housing of an on-vehicle rotating electric machine, and said wiring is a power wiring supplying power to said on-vehicle rotating electric machine.

10. The connector according to claim 9, wherein said power wiring includes a plurality of power cables, said plurality of power cables are accommodated in said main body in a juxtaposed manner, and said first face corresponds to a face along a direction in which said plurality of power cables are juxtaposed.

11. The connector according to claim 1, wherein said main body comprises first and second members supporting said wiring therebetween, and said sound-proof member is attached to said second member on an opposite side of said wiring.

12. The connector according to claim 11, wherein said second member has an inner face facing said wiring, and said first face, on which said sound-proof member is provided, is an outer face of said second member.

13. The connector according to claim 1, wherein said sound-proof member includes a cover facing said first face, and a sound absorbing material located between said cover and said first face, and said main body includes a first member formed with a recess in which said wiring is to be accommodated, and a second member having said first face and forming a lid over said first member with said wiring accommodated, and said connector further comprises a fastening member fastening said cover together with said first and second members.

14. The connector according to claim 1, wherein said connector is used in a hybrid vehicle, said main body is attached to a housing of an on-vehicle rotating electric machine driving a wheel, and said wiring is a power wiring supplying power to said on-vehicle rotating electric machine.

* * * * *